US007255025B2

(12) United States Patent
Dagenais et al.

(10) Patent No.: US 7,255,025 B2
(45) Date of Patent: Aug. 14, 2007

(54) POWER TONG WITH SLIDING JAW

(75) Inventors: Dan Dagenais, Edmonton (CA); Jonanthan Brent Fraser, Ononway (CA); Leslie L. Szalacsi, St. Albert (CA); Hermann Basler, Stony Plain (CA)

(73) Assignee: McCoy Bros. Inc., Edmonton, Alberta ( * ) Notice: Subject to any disclaimer, the term of this patent is extended or adjusted under 35 U.S.C. 154(b) by 277 days.

(21) Appl. No.: 10/534,183

(22) PCT Filed: Apr. 30, 2003

(86) PCT No.: PCT/CA03/00595

§ 371 (c)(1),
(2), (4) Date: May 6, 2005

(87) PCT Pub. No.: WO03/093630

PCT Pub. Date: Nov. 13, 2003

(65) Prior Publication Data

US 2007/0062339 A1 Mar. 22, 2007

(30) Foreign Application Priority Data

Apr. 30, 2002 (CA) ..... 2384050

(51) Int. Cl.
*B25B 13/50* (2006.01)
*B25B 28/00* (2006.01)

(52) U.S. Cl. ..... 81/57.15; 81/57.18; 81/57.21

(58) Field of Classification Search .... 81/57.15–57.17, 81/57.19–57.21
See application file for complete search history.

(56) References Cited

U.S. PATENT DOCUMENTS

| | | | | | |
|---|---|---|---|---|---|
| 3,847,040 | A * | 11/1974 | Bufkin | ..... | 81/57.18 |
| 4,084,453 | A * | 4/1978 | Eckel | ..... | 81/57.18 |
| 4,089,240 | A * | 5/1978 | Eckel | ..... | 81/57.18 |
| 4,250,773 | A * | 2/1981 | Haynes et al. | ..... | 81/57.18 |
| 4,326,435 | A * | 4/1982 | Guillot et al. | ..... | 81/57.34 |
| 4,836,064 | A * | 6/1989 | Slator | ..... | 81/57.18 |
| 5,819,605 | A * | 10/1998 | Buck et al. | ..... | 81/57.33 |
| 5,904,075 | A * | 5/1999 | Buck | ..... | 81/57.18 |
| 2003/0177870 | A1 * | 9/2003 | Neves et al. | ..... | 81/57.2 |

* cited by examiner

*Primary Examiner*—David B. Thomas
(74) *Attorney, Agent, or Firm*—David J. French

(57) ABSTRACT

A power tong (1) or back-up tong has a sliding jaw assembly (6) that may be advanced into the throat (4) of the tong for engagement with a pipe. A camming surface (11) on the inside circumference of the ring gear (10) advances the sliding jaw assembly into full engagement with the well pipe when the ring gear (10) is rotated with respect to the jaw assembly.

4 Claims, 7 Drawing Sheets

POWER TONG WITH SLIDING JAW

FIELD OF THE INVENTION

This invention relates to a power tong for use in the oil industry. More particularly, it relates to a tong for engaging and/or rotating pipe.

BACKGROUND TO THE INVENTION

In the oil industry power tongs are used to either grasp and hold pipe while threaded joints are being made up, or to rotate pipe in order to make up such joints. In the past, power tongs have been provided with jaws that are mounted to swing about a pivot point in order to bring the jaw into bearing engagement against pipe. Jaws of these designs are constrained by upper and lower cage plates to which the jaws are connected.

Typically, several jaws, e.g. two opposed jaws, are advanced inwardly by rotating an outer encircling camming surface about a set of jaws with the pipe located at the center of rotation. This camming surface is typically formed on the inside of a C-shaped ring gear. Camming rollers on the jaws bear against this camming surface, causing the jaws to advance inwardly in response to the inward urging developed by the cam surface as it rotates past the camming rollers. When the jaws pivot about a pivot axis that is fixed in relationship to the cage plates, the path followed by the jaws as they are displaced inwardly is not perfectly radial. Rather the jaws approach the centrally mounted pipe for engagement following an arcuate path. Alternately, in some jaw designs the jaws advance radially towards the center of the tong.

It would be advantageous to provide a power tong of a simplified design that is more convenient to manufacture and which has a more extended camming surface. The present invention addresses that objective.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to the present invention, in one aspect a power tong is provided with a central, powered rotary ring gear having a central pipe-containing region accessible through a throat opening in the side of the ring gear. The inner surface of the ring gear includes a generally crescent-shaped camming surface or surfaces that is of a minimum height adjacent to the throat, rising towards a maximum, inwardly-directed height proceeding towards the inside of the ring gear opposite to the throat.

Mounted above and below the ring gear are twin C-shaped cage plates each with a key-shaped gap. The gap in the "C" of each cage plates is comparable in size and corresponds with the central pipe containing region and throat opening in the ring gear when aligned. These cage plates are free to rotate with respect to the ring gear, but are constrained to maintain a center of rotation corresponding to the center of the ring gear and the drill pipe to be contained therein.

Mounted between the two cage plates is a receiving jaw means preferably in the form of a pair of pivotably mounted pipe receiving jaws that are positioned to receive and center pipe that has passed through the throat in the ring gear and gaps in the cage plates to be positioned centrally within the rotary gear.

A sliding jaw assembly carrying a jaw between upper and lower retaining portions is dimensioned to fit within and pass through the throat in the ring gear so that the sliding jaw may bear against a pipe held in positioned by the receiving jaw means. The upper and lower retaining portions of the sliding jaw assembly are slidingly engaged with the respective cage plates, bearing against the cage plates along the sides of the gap in each plate to maintain the sliding jaw assembly in a central, position within the throat and when advanced past the throat into the central pipe-containing region, centrally located with between the two cage plates. Preferably, such retaining portions are positioned by grooves which serve as friction minimizing slides or track means to provide for their radial advancement towards the central pipe-containing region.

Sliding advancement of the sliding jaw assembly will cause the sliding jaw to become positioned against pipe contained within the central region of the power tong. The radial dimension of the sliding jaw assembly is sufficiently limited so that, once the sliding jaw engages with pipe, rotation of the ring gear becomes possible. Such rotation occurs with the sliding jaw assembly largely positioned inwardly of the camming surface.

A cam follower bearing surface mounted within the sliding jaw assembly is positioned to contact and advance along the camming surface, forcing the sliding jaw inwardly in response to an inwardly-directed force developed by the camming surface. As the jaw assembly advances inwardly, the retaining portions of the sliding jaw assembly also advance inwardly within the C-shaped gap in the cage plates in a radial direction, proceeding towards the center of the tong. This action continues as the ring gear is rotated with respect to the pipe and the cage plates carrying the respective jaws until the sliding jaw on the sliding jaw assembly contacts the pipe. The inwardly directed force developed by the camming surface on the cam follower then causes the sliding jaw to bear tightly against the pipe before the cam follower reaches the maximum height of the camming surface within the ring gear. Once this tight engagement is achieved, the pipe will be forced to rotate with the ring gear along with the cage plates and sliding jaw assembly.

The three jaw power tong of the invention is simpler than many prior art power tongs, having a reduced number of components. Additionally, as the camming surface commences adjacent to the throat and may extend to the opposite side of the ring gear, the camming surface has a longer span of travel. The feature can be used to develop a higher clamping force on pipe by allowing the camming surface to rise more gradually. It is anticipated that this design will therefore enjoy significant advantages in the marketplace.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
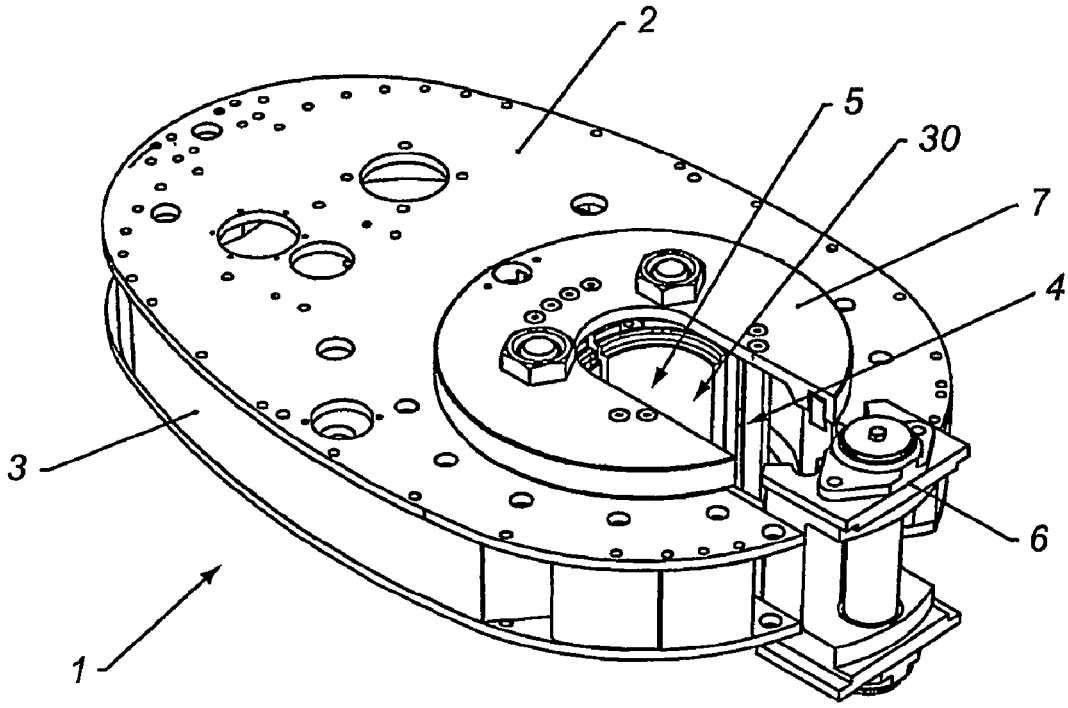
FIG. 1 is a perspective view of a power tong of the invention with a sliding jaw aligned for passage through the throat of the ring gear.

In FIG. 1 a power tong 1 has a top-side covering plate 2 over a frame 3 and a throat region 4 accessing a central region 5. A sliding jaw assembly 6 is positioned for radial advancement within the throat 4.

A top-side "C"-shaped cage plate 7 with a gap 30 corresponding to the ring gear throat surrounds the central region 5. A similar bottom-side cage plate (not shown) is present on the underside of the tong 1.

Figure 2:
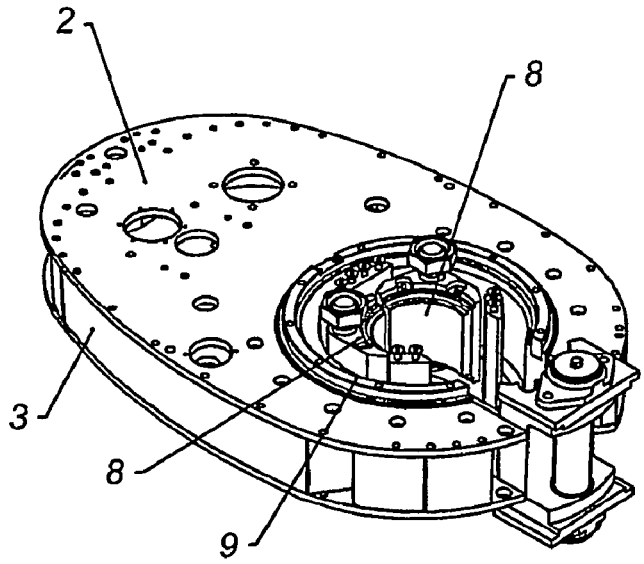
FIG. 2 is the view of FIG. 1 with the top cage plate removed for clarity.
Figure 3:
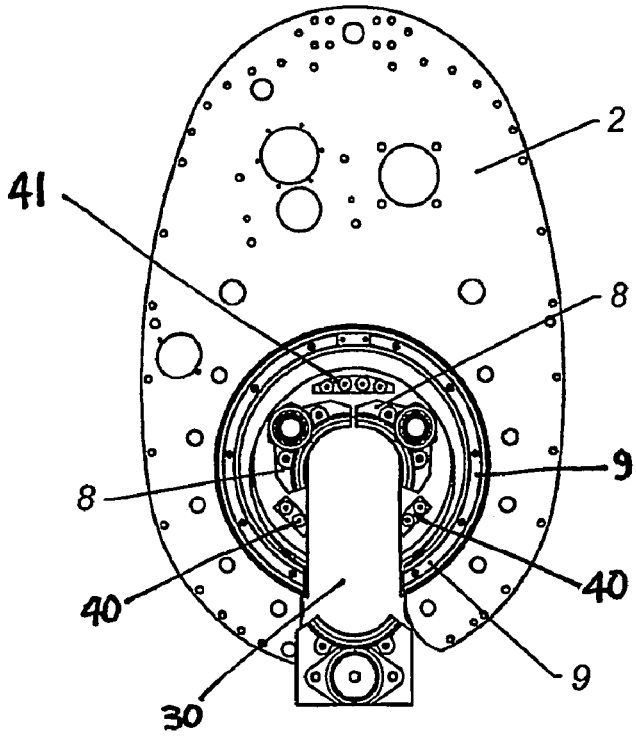
FIG. 3 is a plan view of the tong of FIG. 2.
Figure 5:
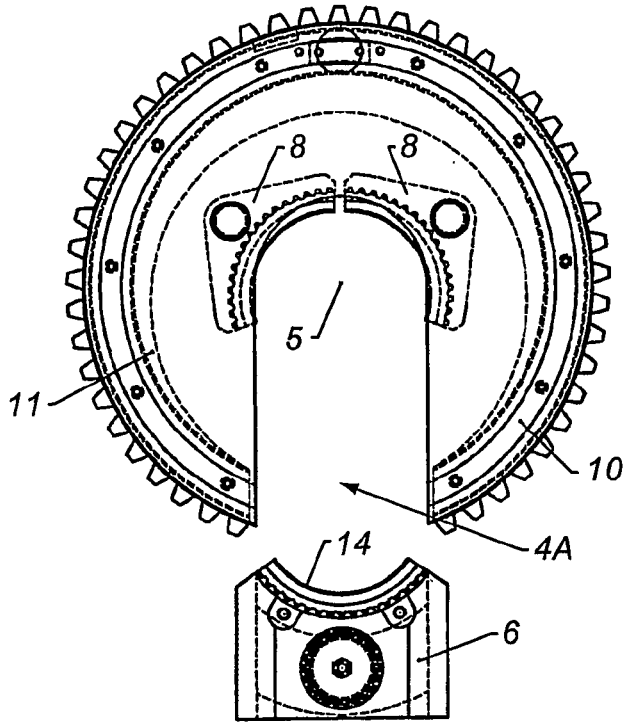
FIG. 5 is a plan view of the ring gear with two receiving jaws and one sliding jaw of FIG. 4 positioned to engage a centrally located pipe (not shown).
Figure 4:
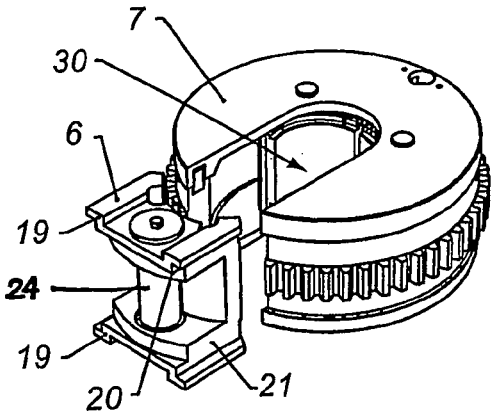
FIG. 4 is a perspective view of a ring gear and cage plate alone according to the invention showing the sliding jaw assembly positioned opposite the throat of the ring gear power tong prior to its advancement into the throat of the ring gear for engagement with drill pipe.
Figure 6:
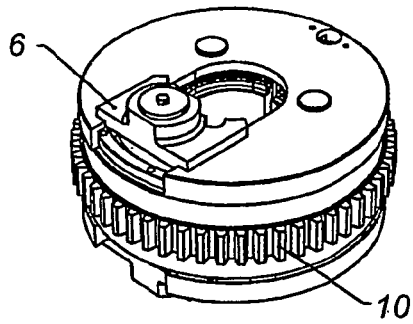
FIG. 6 is the perspective view of FIG. 4, with the sliding jaw assembly advanced to a pipe engaging position, and with the ring gear rotated with respect to the two cage plates which carry the respective jaws.
Figure 7:
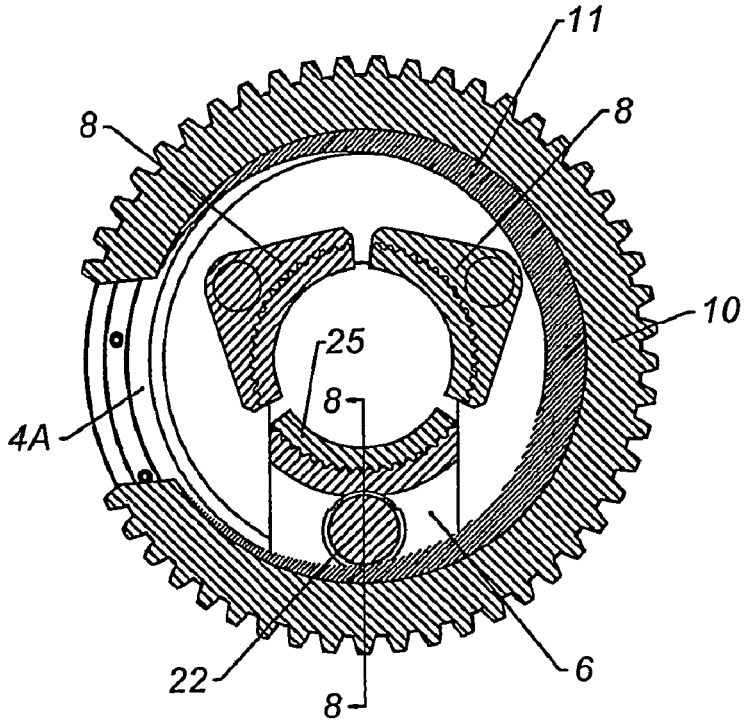
FIG. 7 is a cross-sectional plan view of the receiving jaws and sliding jaw assembly within the ring gear as in FIG. 6, showing the camming roller partially advanced along the camming surface.

In FIGS. 2 and 3 the top-side cage plate 7 is removed for clarity, exposing two pivotally mounted pipe receiving jaws 8 fitted between the cage plates 7 to serve as a receiving jaw means. A "C"-shape rail 9 fits into a groove (not shown) in the underside of the cage page 7 to permit the cage plate to rotate with respect to the covering plate 2. Contained within the body 3 is a train of gears (not shown) to rotate the ring gear.

Shown in FIGS. 2 and 3 but otherwise omitted for clarity are two types of cage-plate spacers 40, 41. Front spacers 40 are adjacent to the gap 30, receiving threaded fasteners (not shown) that pass through the cage plates 7. The rear spacer 41 is similarly mounted behind the two pipe receiving jaws 8.

In FIGS. 4 through 7 a central ring gear 10 surrounds the central pipe-containing region 5, accessible through a throat opening 4A in the side of the ring gear 10. The ring gear 10 is free to rotate with respect to the frame 3. The ring gear 10 is provided with a crescent shaped camming surface 11. This camming surface 11 is of a minimum height adjacent to the ring gear throat 4A, rising to a maximum, inwardly-directed height on the inside of the ring gear 10, preferably, but not necessarily opposite to the throat opening 4A.

As the cage plates 7 are free to rotate with respect to the covering plates 2 they are also free to rotate with respect to the ring gear 10, but are constrained by the rail 9 to maintain a center of rotation corresponding to the center region 5 of the ring gear 10 and the center of drill pipe to be contained in the central region 5.

The pipe receiving jaws 8 are pivotally mounted between the two cage plates 7. These receiving jaws 8 are positioned to receive and self-center pipe that has passed through the throat opening 4A in the ring gear 10 to be positioned centrally within the tong 1. Optionally and preferably the rear spacer 41 may be positioned to support the pipe receiving jaws 8 against further rotation, once pipe has been centrally positioned within the tong.

The sliding jaw assembly 6 as shown in FIGS. 7 to 11 carries a sliding jaw 14 between upper and lower retaining portions 19. The sliding jaw assembly is dimensioned to carry the sliding jaw 14 within and through the throat 4A in the ring gear 10. With further advancement, the sliding jaw 14 may bear against a pipe held in position by the two pipe receiving jaws 8. The upper and lower cage plates 7 maintain the sliding jaw assembly 6 in a central, vertical position within the ring gear throat 4A and with respect to the ring gear 10 through supporting retaining portions 19 on the sliding jaw assembly 6. These retaining portions 19 include grooves 20 which serve as a rail or track means to guide the sliding advancement of the jaw assembly 6 within the gap 30. While grooves 20 are shown as being on the retaining portions 19 of the sliding jaw assembly 6, such grooves may alternately be formed in the cage plates 7 to provide equivalent track 1o means. The sliding jaw assembly 6 can be made from a single "U"-shaped body 21 with the retaining portions 19 formed integrally at the top and bottom sides.

Figure 8:
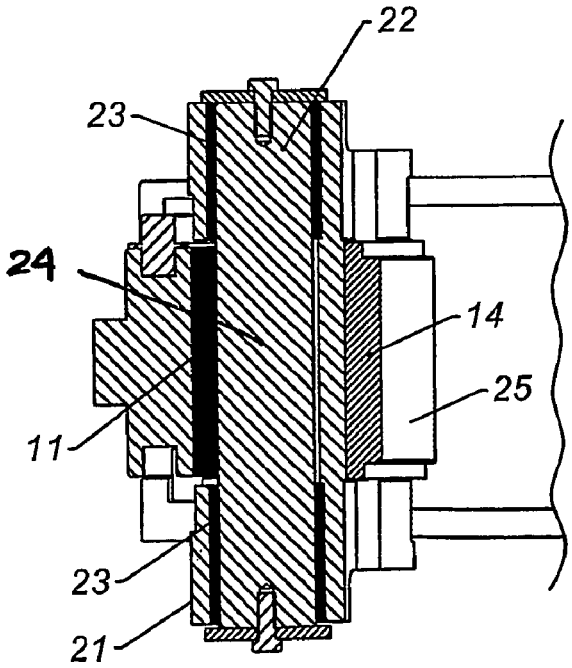
FIG. 8 is a cross-sectional side view through the ring gear assembly of FIG. 7.
Figure 9:
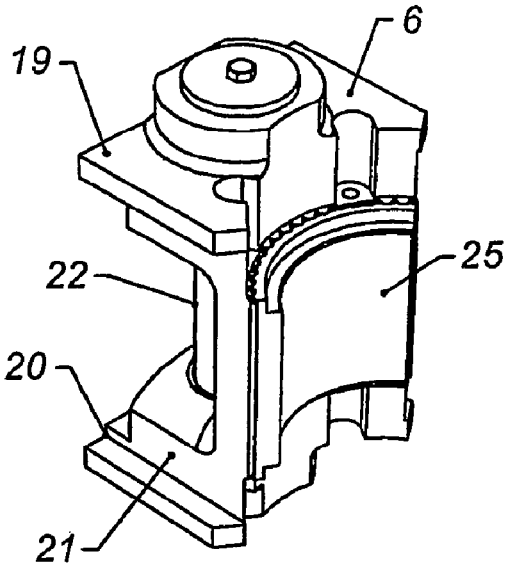
FIG. 9 is a perspective view of the sliding jaw assembly showing the jaw plate mounted therein.
Figure 10:
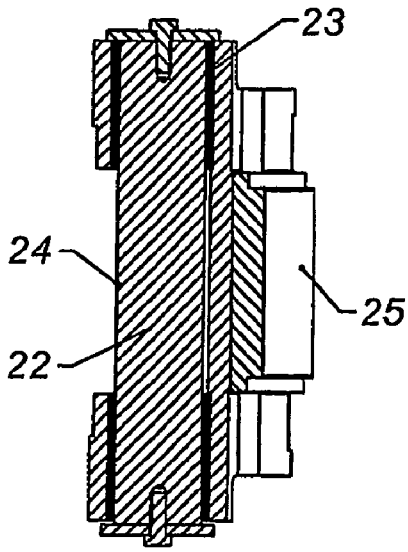
FIG. 10 is a cross-sectional side view of FIG. 9.
Figure 11:
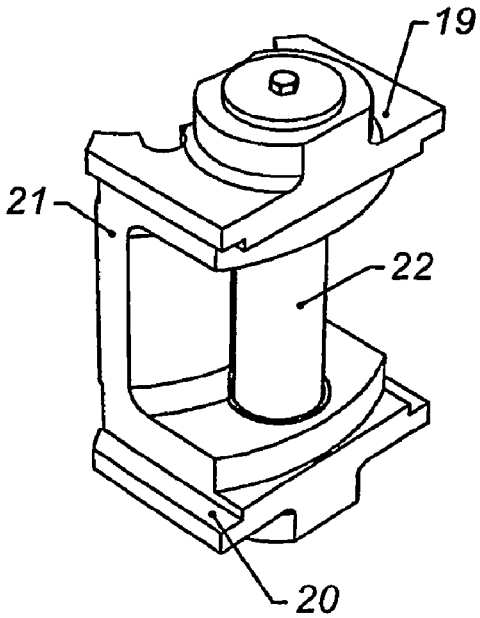
FIG. 11 is a rear perspective view of the sliding jaw assembly of FIG. 9.

A large roller bearing 22 is journaled at its ends into the body 21 by low friction support bearings 23 as shown in FIG. 8. The central region 24 of the roller bearing 22 contacts the camming surface 11 as a cam follower, preferably centrally, and in central alignment with the jaw die plate 25 which is, optionally, removeably mounted on the sliding jaw assembly 6.

Once sliding advancement of the sliding jaw assembly 6 has moved the sliding jaw 14 into position against well pipe contained within the center region 5 of the power tong, the radial depth of the inner portion of the sliding jaw assembly 6 is sufficiently limited so that it is possible to effect rotation of the ring gear 10, with the sliding jaw assembly 6 positioned generally inwardly of the camming surface 11 on the ring gear 10.

The cam roller bearing 22 mounted within the sliding jaw assembly 6 is positioned to contact and advance along the camming surface 11, forcing the sliding jaw 14 and jaw assembly 6 inwardly. This action occurs when the ring gear 10 is initially rotated with respect to the drill pipe and with respect to the cage plates 7 carrying the respective jaws. The inwardly directed force developed by the camming surface 11 on the cam roller 22 causes the sliding jaw 14 to bear tightly against the pipe before the camming roller 22 reaches the maximum height of the camming surface 11 within the ring gear 10. Once this tight engagement is achieved, the pipe will be forced to rotate with the ring gear 10.

When used as a power tong, conventional systems such as hydraulic motors and the like are used to engage with outer gearing around the circumferential periphery of the ring gear 10, causing it and the drill pipe to rotate. When used as a back up tong, the ring gear 10 is fixed against rotation, once the pipe has been fully engaged.

Due to the symmetrical crescent shape of the camming surface 11, the ring gear 10 can be rotated in either direction, allowing the sliding jaw 14 to engage with pipe for the purposes of effecting either the make-up or breaking of threaded joints. Alternately the camming surface 11 can be extended along the entire inner surface of the ring gear if a one-way tong were required. By reason of the fact that only one jaw 14 carries a camming roller 22 that bears against the camming surface 11, the camming surface 11 extends for a greater extent within the ring gear 10 than is typically available in prior art tongs. This permits the depth of the camming surface 11 to increase more gradually, increasing the leverage and force that may be applied to the sliding jaw 14 in order to ensure that it effects a non-slipping engagement with the pipe.

Figure 12:
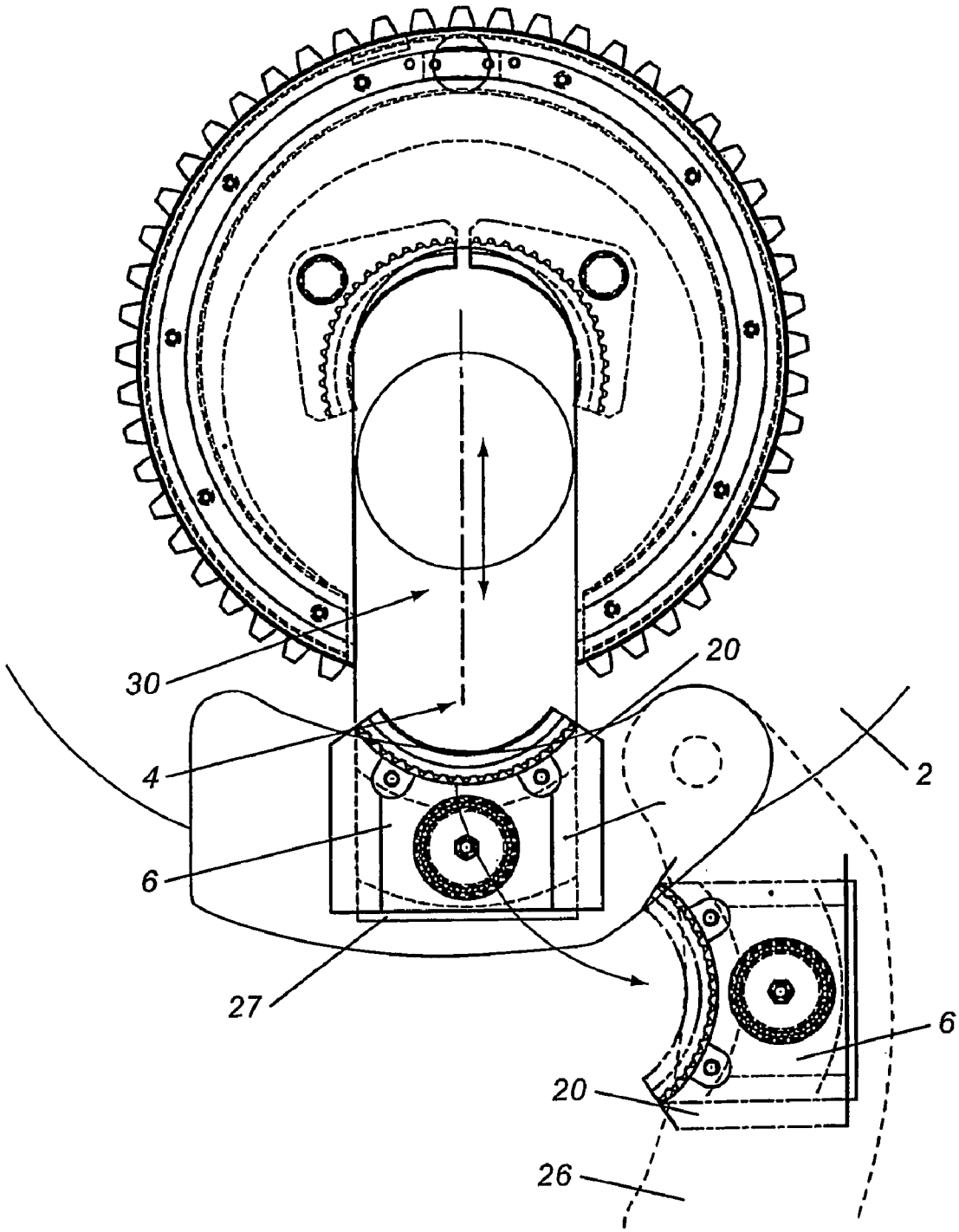
FIG. 12 is a plan view of a portion of a tong having a gate for the throat within which the sliding jaw assembly of the invention may be stored.

In FIG. 12 a gate 26 is pivotally mounted on the tong 1 through the covering plate 2. This gate 26 has a slot 27 of similar width to the gap.30 in the cage plate 7 so that the grooves 20 on the sliding jaw assembly 6 may be supported. With the gate 26 open, the sliding jaw assembly 6 is conveniently stored or "parked", exposing the throat 4 to receive pipe. With the gate 26 closed, the sliding jaw assembly 6 is aligned to advance into the throat 4 of the tong 1.

Figure 13:
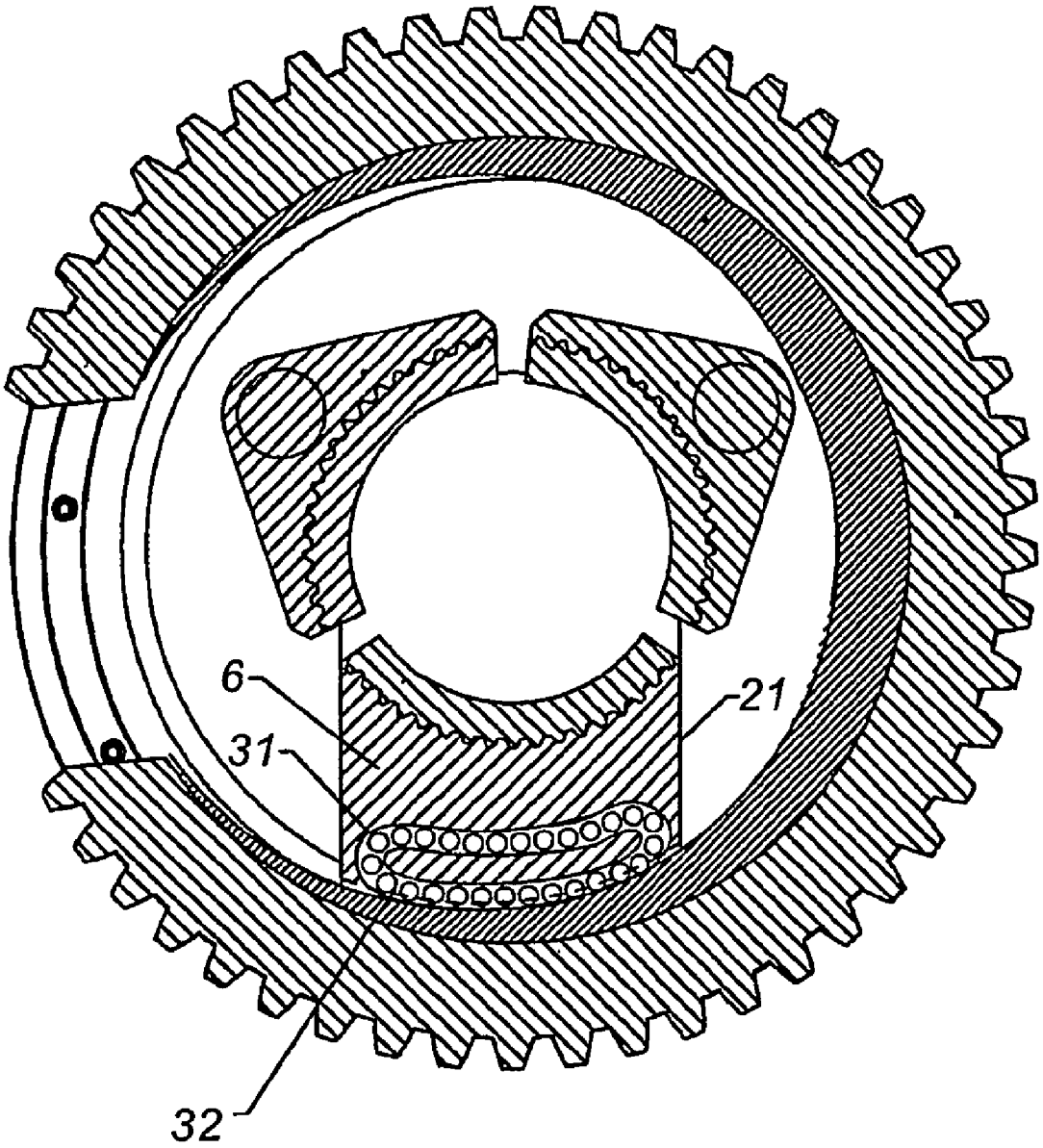
FIG. 13 is a cross-sectional plan view of a ring gear as in FIG. 7 having as the cam follower a series of roller bearings in a circulating race.

In FIG. 13 an alternate cam follower is shown to the roller 22 of FIGS. 7-11. Within the body 21 of the sliding jaw assembly a closed-loop circulating bearing race 32 is formed. Hardened cylindrical rollers 32 are fitted into this bearing race 31, exposed on the side facing the camming surface 11. Such rollers 32 distribute the load developed by the camming surface 11 on the sliding jaw assembly 6 while minimizing friction for this cam follower system. This alternate cam follower is further described in the co-pending U.S. application Ser. No. 10/265,644 and the PCT application claiming priority based thereon, the contents of which are adopted herein by reference. While depicted in respect of a tong with a throat 4, the sliding jaw system and further features of the invention can equally be applied to closed-mouth tongs.

CONCLUSION

The foregoing has constituted a description of specific embodiments showing how the invention may be applied and put into use. These embodiments are only exemplary. The invention in its broadest, and more specific aspects is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property or privilege is claimed are defined as follows:

1. A power tong comprising:

(a) a ring gear having a central pipe-containing region accessible through a throat opening in the side of the ring gear and having an inner surface facing such central region;

(b) a camming surface formed on the inner surface of the ring gear;

(c) twin C-shaped cage plates with outer surfaces rotationally mounted with respect to the ring gear on opposite sides of the ring gear, said cage plates having a gap formed therein that is of a size and position, when aligned, that corresponds with the throat opening and central pipe-containing region in the ring gear, said cage plates being free to rotate with respect to the ring gear, but being constrained to maintain a center of rotation corresponding to the center of the ring gear;

(d) pipe receiving jaw means mounted between said cage plates and positioned to receive pipe that has passed through the throat in the ring gear to be positioned centrally within the ring gear;

(e) a sliding jaw assembly having upper and lower retaining portions slideably engaged with the gap in the upper and lower cage plates to maintain the sliding jaw assembly in a central, position within said throat and between said cage plates, said assembly carrying a sliding jaw mounted between the upper and lower retaining portions, said sliding jaw being dimensioned to fit within and pass through the throat in the ring gear to advance to a pipe-engaging position where it will bear against a pipe held in position by the pipe receiving jaw means, the radial dimension of the sliding jaw assembly being sufficiently limited so that, once the sliding jaw advances to a pipe engaging position rotation of the ring gear becomes possible;

(f) a cam follower mounted within the sliding jaw assembly, positioned to contact and advance along the camming surface when the sliding jaw is in said pipe-engaging position, forcing the sliding jaw, together with the outer retaining portions of the sliding jaw assembly to move inwardly within the gap in the cage plates when the ring gear is initially rotated with respect to the drill pipe and the cage plates whereby the inwardly directed force developed by the camming surface will cause the sliding jaw to bear tightly against pipe contained within the tong, thereby engaging the ring gear with said pipe.

2. A power tong as in claim 1 wherein said camming surface is of minimum height adjacent to the throat, and rising to a maximum, inwardly-directed height on the inside of the ring gear opposite to the throat.

3. A power tong as in claim 1 having a frame supporting the ring gear and further having a gate which is positionable to close over the outer end of the throat opening in the ring gear and further dimensioned to receive and carry the sliding jaw assembly from a position within the throat to a parked position that leaves the throat exposed to receive pipe.

4. A power tong or back-up tong having a throat, a central region for receiving pipe, a ring gear with an inside surface, a camming surface on the inside circumference of the ring gear and a sliding jaw assembly that may be advanced into the throat of the tong for positioning with said central region, said jaw assembly carrying cam following means for advancement along the camming surface to effect full engagement with the well pipe when the ring gear is rotated with respect to the jaw assembly.

* * * * *